US008133072B2

(12) United States Patent
Huang et al.

(10) Patent No.: US 8,133,072 B2
(45) Date of Patent: Mar. 13, 2012

(54) CABLE ASSEMBLY WITH IMPROVED COUPLING STRUCTURE

(75) Inventors: Chien-Hsun Huang, Tu-Cheng (TW); Zhi-Guo Wang, Kunshan (CN); Zhi-Feng Lin, Kunshan (CN); Yang-Chu Guo, Kunshan (CN); Chun-Guang Wan, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 158 days.

(21) Appl. No.: 12/753,311

(22) Filed: Apr. 2, 2010

(65) Prior Publication Data

US 2010/0255712 A1 Oct. 7, 2010

(51) Int. Cl.
*H01R 11/00* (2006.01)

(52) U.S. Cl. ..... 439/502

(58) Field of Classification Search ..... 439/502, 439/660, 350, 352, 358, 447, 668
See application file for complete search history.

(56) References Cited

U.S. PATENT DOCUMENTS

| | | | | |
|---|---|---|---|---|
| 6,976,865 | B2 * | 12/2005 | Wu | 439/352 |
| 7,112,076 | B2 * | 9/2006 | Wu | 439/160 |
| 7,207,832 | B2 * | 4/2007 | Liu et al. | 439/499 |
| 7,585,184 | B2 * | 9/2009 | Su et al. | 439/579 |
| 7,914,320 | B2 * | 3/2011 | Ko | 439/490 |
| 2008/0214054 | A1 * | 9/2008 | Su et al. | 439/637 |
| 2008/0280495 | A1 * | 11/2008 | Ko | 439/638 |

FOREIGN PATENT DOCUMENTS

| | | |
|---|---|---|
| CN | 2593389 Y | 12/2002 |
| CN | 2824366 Y | 10/2005 |

* cited by examiner

*Primary Examiner* — Edwin A. Leon
(74) *Attorney, Agent, or Firm* — Wei Te Chung; Andrew C. Cheng; Ming Chieh Chang

(57) ABSTRACT

A cable assembly includes a cover, a first connector, a cable, and a second connector. The first connector includes a housing, a plurality of terminals received in the housing, and a metal shell. The cable includes a first end electrically connected to the first connector and a second end. The second connector is electrically connected to the second end of the cable. The first connector is attached on the cover and includes a mating surface parallel to the cover. The first end of the cable is arranged on one side of the first connector and the second connector includes a mating surface perpendicular to the cover.

13 Claims, 5 Drawing Sheets

CABLE ASSEMBLY WITH IMPROVED COUPLING STRUCTURE

BACKGROUND OF THE INVENTION

1. Field of the Invention

The present invention relates generally to a cable assembly, and more particularly to a cable assembly with improved coupling structure for being used on a movable electronic device.

2. Description of the Prior Art

At present, movable electronic devices become smaller, thinner, and lighter. Accordingly, some cable assemblies in uncommon use, such as cable assemblies used to transmit video signals, sometimes could be canceled in movable electronic devices for saving space. However, these cable assemblies sometimes are needed for movable electronic devices connecting other electronic devices. Thus, a cable assembly which can be received in idle space of a movable electronic device is fit for pint-sized movable electronic devices. However, present cable assembly cannot be assembled in small idle space of a movable electronic device.

Hence, in this art, a cable assembly to overcome the above-mentioned disadvantages of the prior art should be provided.

BRIEF SUMMARY OF THE INVENTION

A primary object, therefore, of the present invention is to provide a cable assembly with an improved coupling structure.

In order to implement the above object, a cable assembly comprises a cover, a first connector, a cable, and a second connector. The first connector comprises a housing, a plurality of terminals received in the housing, and a metal shell. The cable comprises a first end electrically connected to the first connector and a second end. The second connector is electrically connected to the second end of the cable.

The first connector is attached on the cover and comprises a mating surface parallel to the cover. The first end of the cable is arranged on one side of the first connector and the second connector comprises a mating surface perpendicular to the cover.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
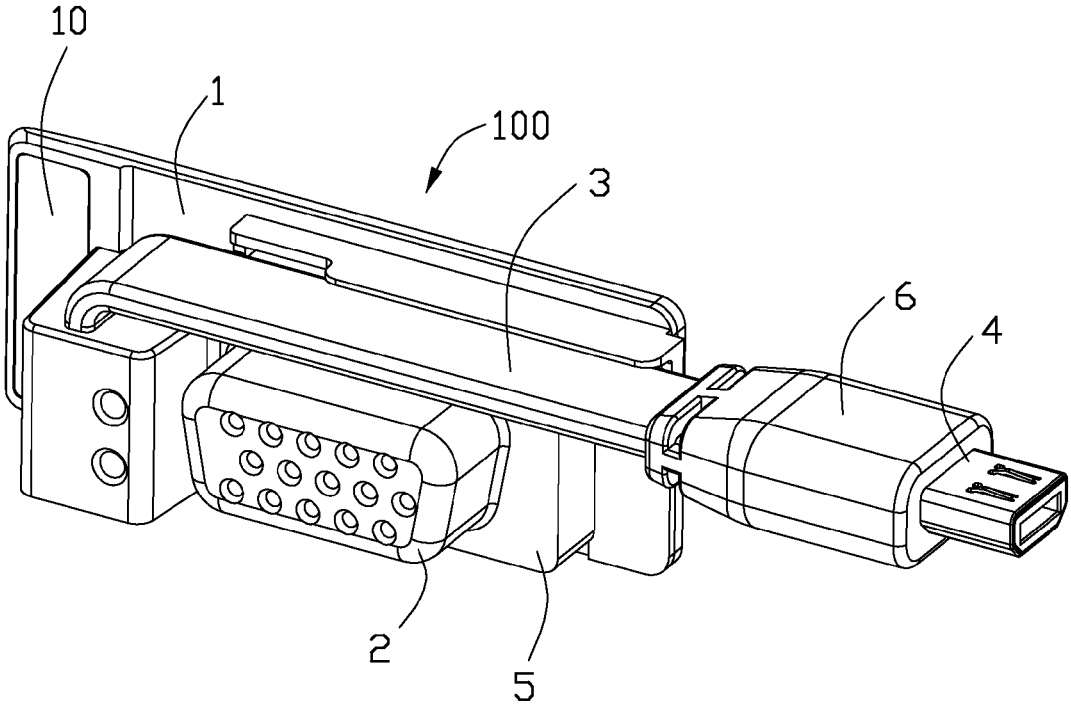
FIG. 1 is a perspective view of a cable assembly in according with the present invention.
Figure 2:
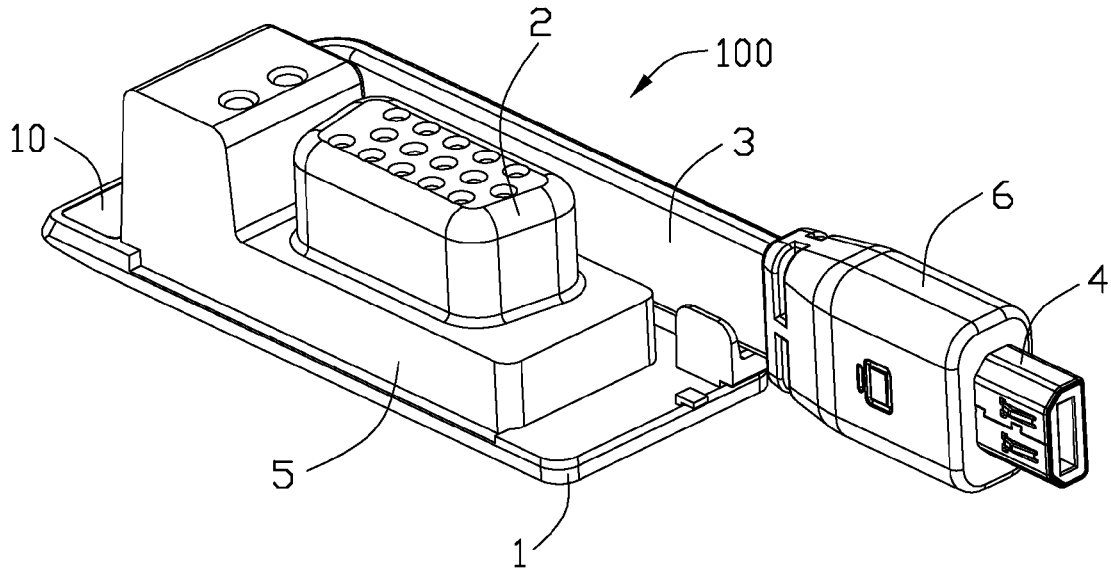
FIG. 2 is a view similar to FIG. 1, but taken from a different aspect.
Figure 3:
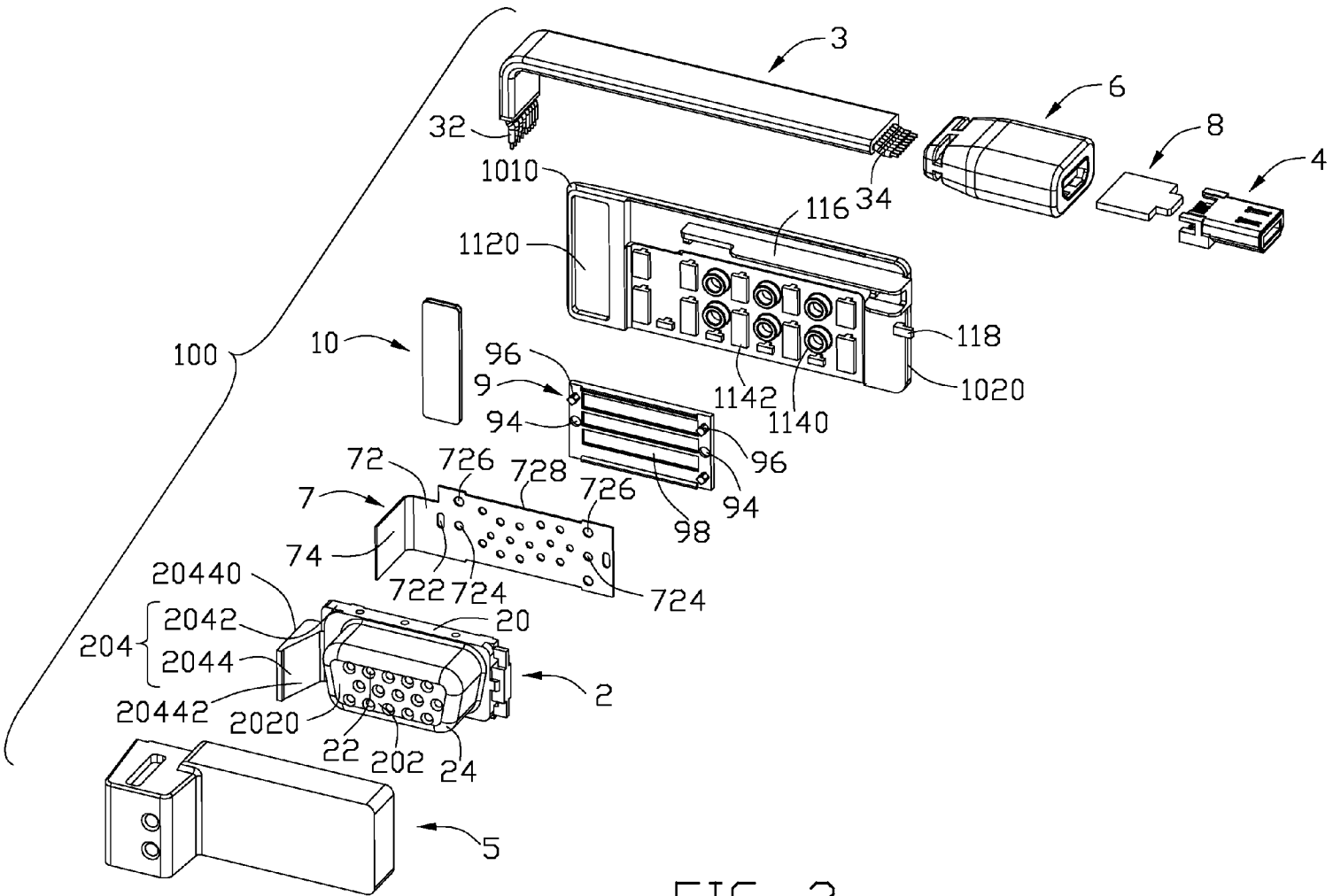
FIG. 3 is an exploded, perspective view of the cable assembly in according with the present invention.
Figure 4:
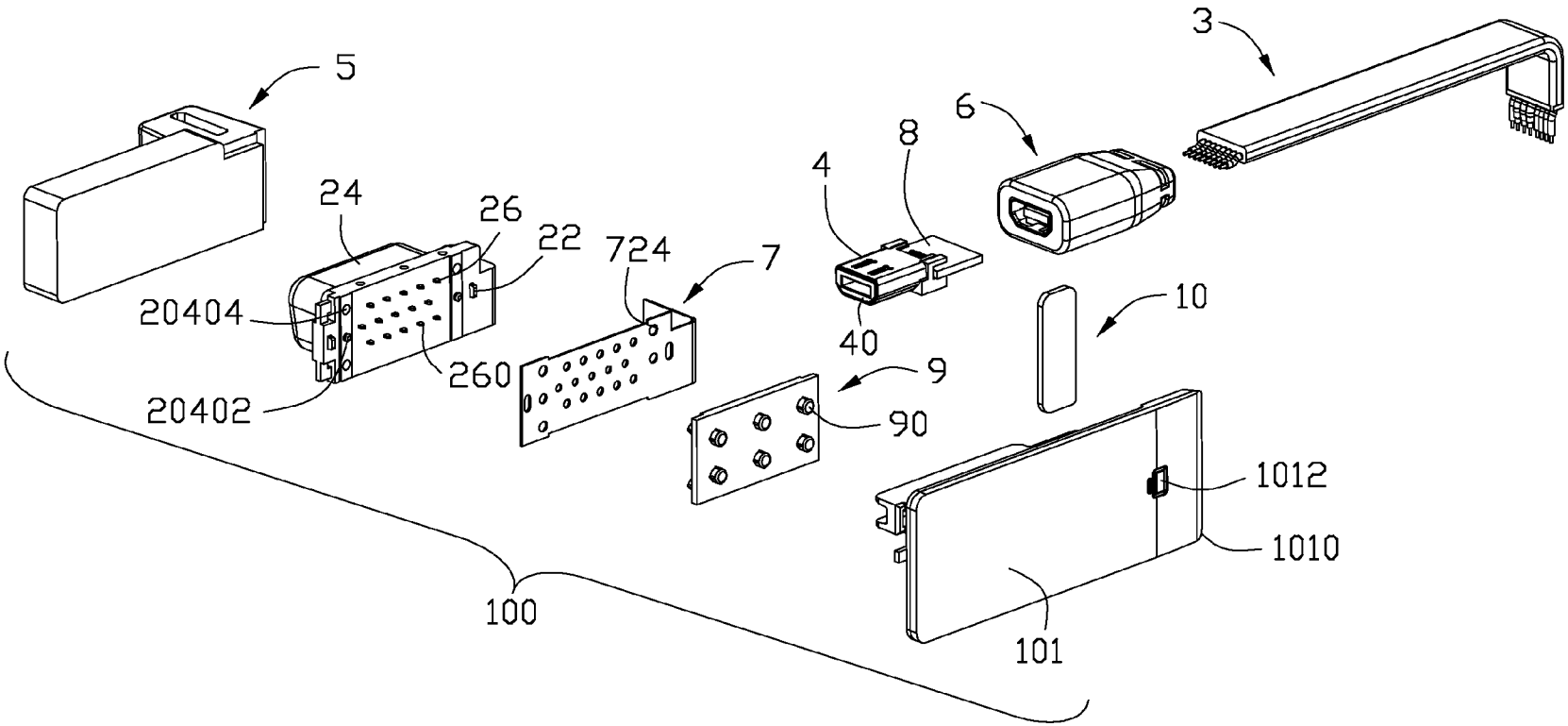
FIG. 4 is a view similar to FIG. 3, but taken from a different aspect.
Figure 5:
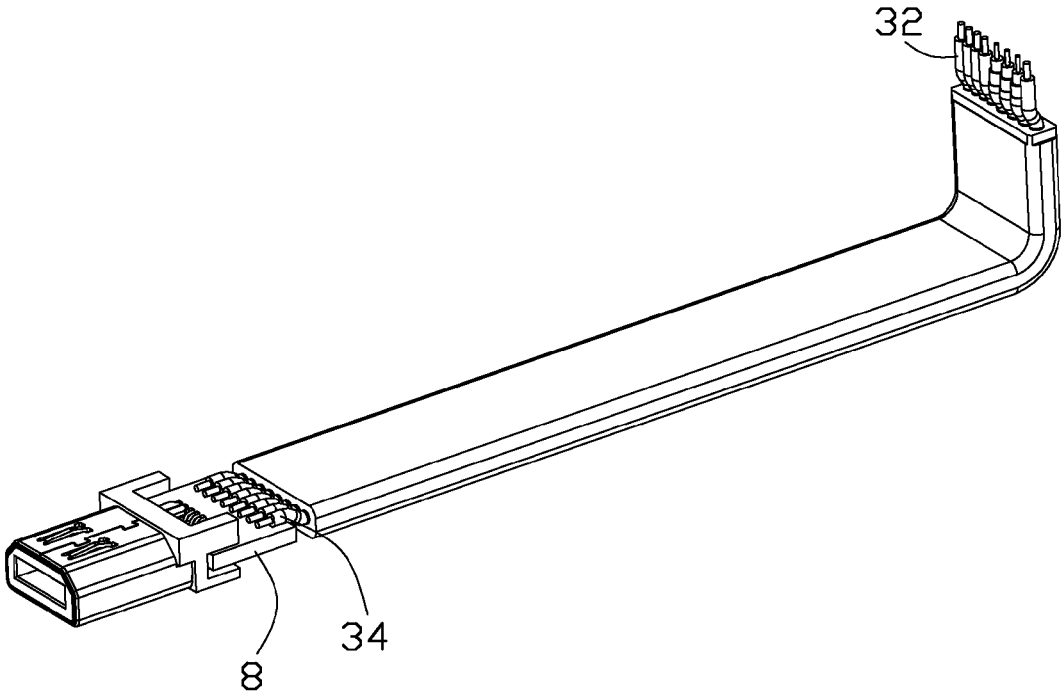
FIG. 5 is an assembled perspective view of a cable, a second connector and a printed circuit board of the present invention.

Reference to FIG. 1 to FIG. 5, a cable assembly in according with a preferred embodiment of the present invention is shown. The cable assembly 100 is used to be fastened on an electronic device (not shown), and comprises a cover 1, a first connector 2, a cable 3, and a second connector 4.

The first connector 2 comprises a housing 20 with a plurality of receiving holes 22, a plurality of terminals 26 received in the receiving holes 22 of the housing 20, and a metal shell 24. The housing 20 comprises a mating portion 202 with a mating surface 2020 and a base portion 204 made at the same time with the mating portion 202. The mating surface 2020 is parallel to the cover 1. The base portion 204 is substantially of L-shaped configuration and comprises a bottom portion 2042 connected to the mating portion 202 and a extended portion 2044 extending from one side of the bottom portion 2042. The extended portion 2044 is substantially of triangle, and comprises an outer side 20440 substantially perpendicular to the cover 1, and an inner side 20442 being of a inclined plane. The metal shell 24 covers the mating portion 202.

The cable 3 comprises a first end 32 electrically connected to the first connector 2 and a second end 34 connected to the second connector 34. The cable 3 comprises a plurality of wires which are arranged in line and perpendicular to the cover 1.

The cable assembly 100 further comprises a flat printed circuit 7 connecting the first connector 2 to the first end 32 of the cable 3. The flat printed circuit 7 comprises a first connecting portion 72 connected to the terminal 26 of the first connector 2 and a second connecting portion 74 connected to the first end 32 of the cable 3. The terminals 26 are received in the mating portion 202 of the housing 20 and have tails 260 extending through the bottom portion 2042 to exploded out the housing 20 The first connecting portion 72 of the flat printed circuit 7 is electrically connected to the tails 260 of the terminals 26. The second connecting portion 74 extends along the out side of the extended portion 2044 of the housing 20, and the first end 32 of the cable 3 is connected to the second connecting portion 74 on the out side of the extended portion 2044. An external mold 5 is over molded to receive the base portion 204 and the flat printed circuit 7, and fasten the base portion 204 and the flat printed circuit 7 on the cover 1.

The cable assembly 100 further comprises a fixing board 9 located between the flat printed circuit 7 and the cover 1, and received in the external mold 5. The fixing board 9 comprises a first surface 902 connected to the flat printed circuit 7 and a second surface 904 connected to the cover 1. The first surface 902 comprises a pair of round concaves 94 arranged on two sides thereof, a plurality of poles 96 arranged on two sides thereof and a plurality of receiving grooves 98 arranged between the round concaves 94. The tails 260 of the terminals 26 extends through the flat printed circuit 7 and are received in the receiving grooves 98. The bottom portion 2042 of the housing 20 comprises a pair of poles 20402 corresponding to the pair of round concaves 94 and a plurality of concaves 20404 corresponding to the poles 96 of the fixing board 9. The flat printed circuit 7 comprises a plurality of holes 726, 724 corresponding to the poles 96, 20402 of the fixing board 9 and the bottom portion 2042. The second surface 904 comprises a plurality of poles 90. The cover 1 comprises a plurality of hollow poles 1140 corresponding to the poles 90 of the second surface 904 of the fixing board 9, and the poles 90 of the second surface 904 are received in the hollow poles 1140 of the cover 1.

The cover 1 comprises a first surface 101 and a second surface 102. The second surface 102 comprises a plurality of T-shaped sticks 1142 respectively arranged on two sides of said hollow poles 1140 in a distributed manner, a receiving trough 1120 located on a first end 1010 thereof and separated from the external mold 5, a fastening portion 116 separated form the external mold 5 and perpendicular to the receiving trough 1120, and a pin 118 located on a second end 1020. The cable assembly 100 further comprises a magnet 10 received in the receiving trough 1120. The cover 1 is fastened on the electronic device through the magnet 10 and the pin 118. The cable 3 can be fastened in the fastening portion 116 and can be taken out from the fastening portion 116 easily. When the cover 1 is fastened on the electronic device, the first surface 101 is a part of the cover (not shown) of the electronic device.

The second connector 4 comprises a printed circuit board 8 connecting second end 34 of the cable 3 to the second connector 4, a casing 6 over molded on the second connector 4, the printed circuit board 8, and the second end 34 of the cable 3, and a mating surface 40 being perpendicular to the cover 1.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable assembly, comprising: a cover; a first connector, comprising a housing, a plurality of terminals received in the housing, and a metal shell; a cable, comprising a first end electrically connected to the first connector and a second end; and a second connector, electrically connected to the second end of the cable; wherein said first connector is attached on the cover and comprises a mating surface parallel to the cover, said first end of the cable is arranged on one side of the first connector and the second connector comprises a mating surface perpendicular to the cover; a flat printed circuit connecting the first connector to the first end of the cable; an external mold over molded on the first connector, the flat printed circuit, and the end of the cable and fastens the first connector, the flat printed circuit and the end of the cable on the cover; said flat printed circuit comprises a first connecting portion connected to the terminal of the first connector and a second connecting portion connected to the first end of the cable.

2. The cable assembly as claimed in claim 1, wherein said housing comprises a mating portion with said mating surface and a base portion made at the same time with the mating portion, said base portion is substantially of L-shaped configuration and comprises a bottom portion connected to the mating portion and an extended portion extending from one side of the bottom portion.

3. The cable assembly as claimed in claim 2, wherein said terminals are received in the mating portion of the housing and have tails extending through the bottom portion to exposed out the housing, said first connecting portion of the flat printed circuit is electrically connected to the tails of the terminals.

4. The cable assembly as claimed in claim 3, wherein said second connecting portion of the flat printed circuit extends along the out side of the extended portion of the housing, and the first end of the cable is connected to the second connecting portion on the out side of the extended portion.

5. The cable assembly as claimed in claim 4, further comprises a fixing board located between the flat printed circuit and the cover, said fixing board comprising a first surface connected to the flat printed circuit and a second surface connected to the cover.

6. The cable assembly as claimed in claim 5, wherein said first surface of the fixing board comprises a pair of round concaves arranged on two sides thereof, a plurality of poles arranged on two sides thereof and a plurality of receiving grooves arranged between the round concaves, said tails of the terminals extend through the flat printed circuit and are received in the receiving grooves, the bottom portion of the housing comprises a pair of poles corresponding to the pair of round concaves and a plurality of concaves corresponding to the poles of the fixing board, and the flat printed circuit comprises a plurality of holes corresponding to the poles of the fixing board and the bottom portion.

7. The cable assembly as claimed in claim 5, wherein said second surface of the fixing board comprises a plurality of poles, the cover comprises a plurality of hollow poles corresponding to the poles of the second surface of the fixing board, and the poles of the second surface of the fixing board are received in the hollow poles of the cover.

8. The cable assembly as claimed in claim 5, wherein said cover comprises a plurality of T-shaped sticks respectively arranged on two sides of said hollow poles in a distributed manner.

9. The cable assembly as claimed in claim 1, wherein said second connector comprises a printed circuit board connecting the second end of the cable to the second connector.

10. A cable assembly, comprising: a cover; a connector attached on the cover and comprising a mating portion with a mating surface parallel to the cover; and a cable electrically connected to the connector, arranged on one side of the connector and perpendicular to the cover, and comprising an end electrically connected to the connector; and a flat printed circuit connecting the end of the cable to the connector; said connector further comprises a base portion connected to the mating portion, said cable assembly further comprises an external mold over molded on the said base portion, the flat printed circuit, and the end of the cable and fastens the base portion, the flat printed circuit and the end of the cable on the cover; a second connector having a mating surface perpendicular to the cover; a fixing board located between the flat printed circuit and the cover and received in the external mold.

11. An electrical cable connector assembly comprising: a first connector defining a mating portion defining long and short sides thereof and communicating with an exterior in a first direction for being enclosed by a metal shell of a first complementary connector; a plurality of contacts disposed in the housing; and a cable including an near end located by the short side of the mating portion and extending along the long side of the mating portion in a restrictive manner; wherein a flexible printed circuit has a first connecting portion mechanically and electrically connected to the contacts, and a second connecting portion mechanically and electrically connected to the near end of the cable; wherein the first connecting portion and the second connecting portion are essentially perpendicular to each other.

12. The electrical cable connector assembly as claimed in claim 11, wherein said cable defines a far end opposite to the near end, and a second connector is attached to the far end for mating with a second complementary connector.

13. The electrical cable connector assembly as claimed in claim 12, wherein the cable includes a first portion at the near end located beside the short side of the mating portion, and a second portion extend along the long side of the mating portion and connected to the second complementary connectors, and the first portion and the second portion are essentially perpendicular to each other.

* * * * *